United States Patent [19]

Schill

[11] 4,124,262

[45] Nov. 7, 1978

[54] HARDWARE FOR PIVOTING CABINET SHELF

[75] Inventor: John M. Schill, Kitchner, Canada

[73] Assignee: Keystone Consolidated Industries, Inc., Peoria, Ill.

[21] Appl. No.: 901,226

[22] Filed: Apr. 28, 1978

[51] Int. Cl.[2] ..... A47B 97/00; A47B 95/00

[52] U.S. Cl. ..... 312/305; 16/151; 312/238; 312/286; 312/307

[58] Field of Search ..... 312/11, 59, 286, 202, 312/238, 252, 197, 125, 305, 307; 16/151, 179; 211/131

[56] References Cited

U.S. PATENT DOCUMENTS

| | | | |
|---|---|---|---|
| 264,747 | 9/1882 | Potts | 312/197 |
| 2,905,518 | 9/1959 | Doesken | 312/305 |
| 3,868,157 | 2/1975 | Robinson | 312/286 |

FOREIGN PATENT DOCUMENTS

| | | | |
|---|---|---|---|
| 357,915 | 9/1922 | Fed. Rep. of Germany | 312/305 |

*Primary Examiner*—Mervin Stein
*Assistant Examiner*—Alex Grosz
*Attorney, Agent, or Firm*—Allegretti, Newitt, Witcoff & McAndrews

[57] ABSTRACT

Hardware for a reversible kitchen cabinet shelf includes upper and lower molded or stamped plates which are attached respectively to the upper and lower panels of a cabinet. The plates include an arcuate track and a transverse guide slot which is generally perpendicular to the front edge of the cabinet. Followers attached to the top and bottom of a shelf unit for the cabinet cooperate with the arcuate track and slot whereby the shelf construction may be pivoted and reversed with respect to the cabinet enclosure.

2 Claims, 8 Drawing Figures

HARDWARE FOR PIVOTING CABINET SHELF

BACKGROUND OF THE INVENTION

This invention relates to improved hardware for mounting a shelf unit reversibly within a cabinet structure.

Kitchen cabinets and the like typically include a cabinet enclosure with a series of shelves mounted therein. The depth of such shelves may be limited in view of the reach required to obtain access to the back side of the shelves. For this reason, quite often kitchen cabinets are of limited depth and often do not adequately utilize the available space.

In an effort to overcome this difficulty, the present inventor developed a reversible shelf assembly. The shelf assembly includes an integral shelf unit having pivot supports. Followers along the top and the bottom of the shelf unit cooperate with tracks and grooves cut into the top panel and bottom panel of the cabinet enclosure. The grooves serve to guide the movement of the shelf unit. A construction of this general type has heretofore been manufactured and sold as part of cabinet structure in the dominion of Canada. So far as applicant knows, no sales or disclosure of the described reversible shelf construction have occurred in the United States. The referenced disclosures and sales in Canada did, however, occur, more than a year prior to the filing date of this application.

With respect to the particular cabinet construction just described, various disadvantages were observed. For example, during manufacture of the reversible shelf cabinets, grooves would necessarily need to be cut in the cabinet enclosure. Machining operations associated with such groove cutting were expensive, tedious and did not necessarily provide a proper groove arrangement for mounting the shelf unit. However, once the unit was completely manufactured and assembled, it worked quite well.

In order to overcome difficulties associated with the manufacture of a reversible shelf construction for a cabinet, the present invention was developed. The invention relates to a kit of hardware which may be combined with a shelf unit for mounting that shelf unit within a cabinet so that the shelf unit is reversible. The hardware of the present invention requires no special cutting operations or other work to be performed upon the cabinet. The hardware is merely mounted within the cabinet for cooperation with a shelf unit.

SUMMARY OF THE INVENTION

In a principal aspect, the present invention relates to an improved assembly of cabinet hardware, particularly for mounting a shelf unit reversibly within a cabinet. The hardware includes formed top and bottom plates which are mounted within the cabinet in opposed relation. Each plate includes an arcuate slot as well as a guide or slot transverse to the front edge of the cabinet. Followers and pivot mounting members attached to the shelf unit cooperate with the slot and pivot mount defined in the plates to permit movement of the shelf unit reversibly within the cabinet.

It is thus an object of the present invention to provide an improved hardware kit for utilization with a cabinet and shelf unit to provide for reversible mounting of the shelf unit.

A further object of the present invention is to provide an improved collection of hardware for a reversible shelf unit in a cabinet which is easily assembled and which is cooperative wth existing cabinetry.

Still another object of the present invention is to provide cabinet hardware which may be utilized with existing cabinetry without modifying the cabinetry and which will simultaneously provide a reversible shelf capability for the cabinetry.

Another object of the present invention is to provide an economically manufactured and easily assembled reversible shelf unit for a cabinet.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
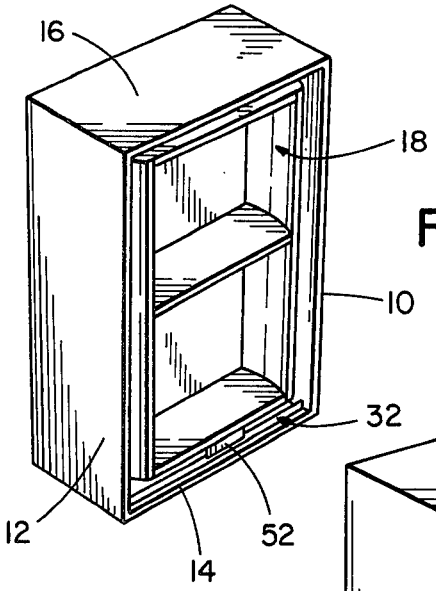
FIG. 1 is a perspective view of a typical cabinet including a reversible shelf unit mounted therein by means of the improved hardware of the present invention.

Referring to the figures, a typical kitchen cabinet includes side panels 10 and 12, a connecting bottom panel 14 and a top panel 16. With the improved hardware and reversible shelf assembly of the present invention, a shelf unit 18 is reversibly positioned within the cabinet defined by panels 10, 12, 14 and 16.

The shelf unit 18 includes a bottom shelf 20, a middle shelf 22 and an upper support panel 24. A vertical wall 26 divides the shelves 20 and 22 into a front half and back half. The shelves 20 and 22 as well as the support panel 24 are rigidly interconnected by means of curved side walls 28 and 30. The dimensions of the shelf unit 18 are such that the unit 18 may be fitted within the enclosure defined by the panels 10, 12, 14 and 16.

Figure 2:
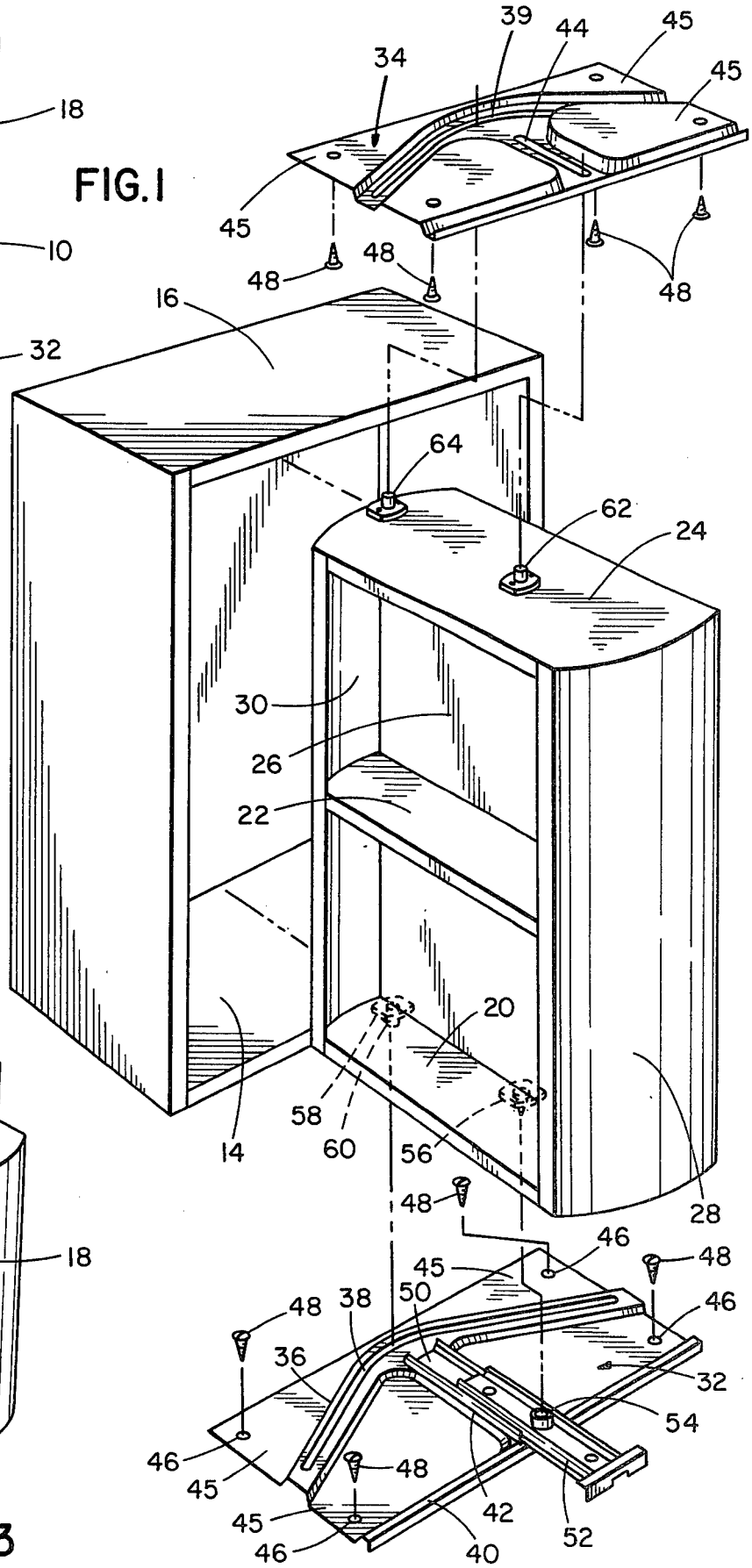
FIG. 2 is an exploded, perspective view of the cabinet hardware, shelf unit and cabinet illustrated in FIG. 1.

Referring to the drawings, the hardware for mounting the shelf unit 18 and providing reversibility for the unit 18 includes substantially identical opposed molded, stamped or pressed steel, plastic or other suitable material formed as a lower mounting plate 32 and upper mounting plate 34. Plates 32 and 34 are substantially identical, though they are arranged in opposed relation as illustrated in FIG. 2.

Referring first, therefore, to lower mounting plate 32, the plate includes a raised arcuate ridge 36 with a guide slot 38 cut therethrough. A front ridge or rail 40 provides rigidity for plate 32. A transverse raised ridge 42 extends between rail 40 and ridge 36. As shown in the top portion of FIG. 2 with respect to upper mounting plate 34, the mounting plate 34 includes an elongated slot 44 within the ridge 42.

Each plate 32, 34 includes corner support legs 45 which support and maintain the plates 32, 34 and more particularly the projected surfaces defining the ridges 36, 40, 42, properly spaced and positioned in the cabinet. Openings 46 in the plates 32, 34 receive screws 48 as fastening means for attaching the plates 32, 34 to the panels 14, 16 respectively. The plates 32, 34 are dimensionally approximately equal to the inside dimensions of panels 14, 16 respectively.

A guide track 50 is attached to the ridge 42 of lower plate 32. A sliding rail 52 fits within the guide track 50 for movement transverse to the front rail 40. The guide rail 52 includes a center pivot mount 54.

Attached to the bottom shelf 20 at the center of the shelf unit 18 is a downwardly projecting pivot 56 which cooperates with the pivot mount 54. An elongated follower 58 is attached to the outside edge of side wall 30 on the bottom shelf 20. Follower 58 includes a projecting lug 60 which engages slot 38.

Diametrically opposed and positioned on the upper support panel 24 exactly opposite the pivot 56 is a support follower 62. Support follower 62 engages slot 44 in bracket 34. A guide follower 64 which is the counterpart of follower 58 is attached to the upper support panel 24. Follower 64 engages slot 39 in upper bracket 34.

Having thus described the assemblage and construction of the parts comprising the invention, the following is a description of the operation thereof.

Figure 5:
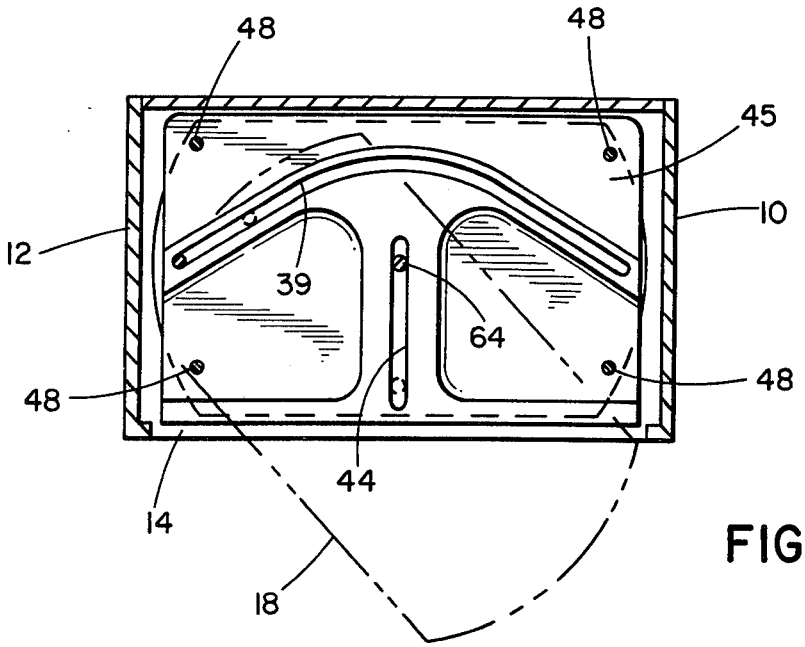
FIG. 5 is a top plan, cross-sectional view of the improved shelf unit and cabinet construction of the present invention.
Figure 6:
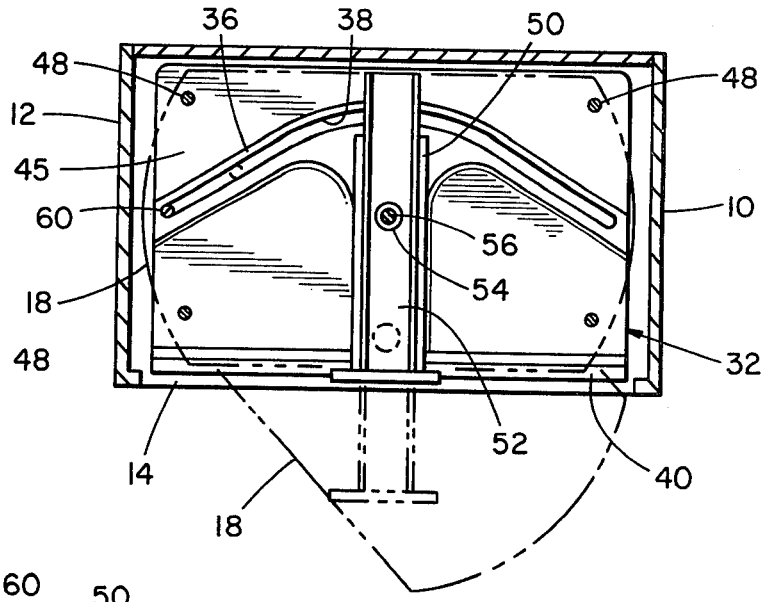
FIG. 6 is a top plan, cross-sectional view similar to FIG. 5 showing the bottom mounting plate for the hardware for the reversible shelf unit.

As previously recited, FIG. 1 represents the shelf unit in a typical normal position within the cabinet enclosure. To reverse the shelf unit 18, the shelf unit 18 is first pivoted to the position illustrated in FIG. 3. This is accomplished by simultaneously pivoting the shelf unit 18 about the pivot member 56 and translating the pivot member 56 toward the front rail 40 of plate 32 as shown in FIG. 6. This causes the follower 60 to move clockwise within the slot 38 as also illustrated in FIG. 6. Also simultaneously, the top pivot member 62 and top follower 64 attached to the top panel 24 will move in the same manner in the slots 44 and 39 respectively in the top plate 34. Movement in the top plate 34 is illustrated in FIG. 5.

Figure 3:
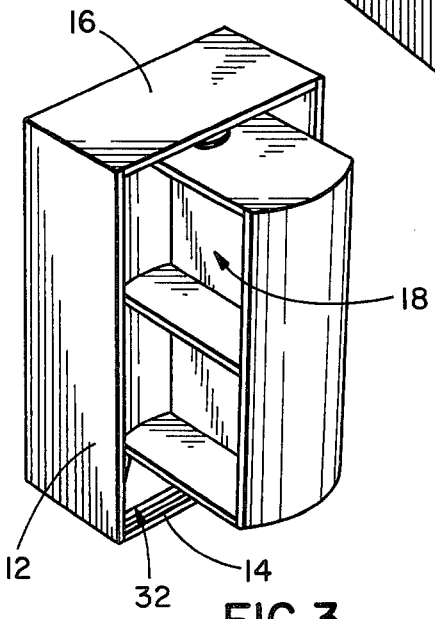
FIG. 3 is a perspective view similar to FIG. 1 wherein the shelf unit has been rotated 90°.
Figure 4:
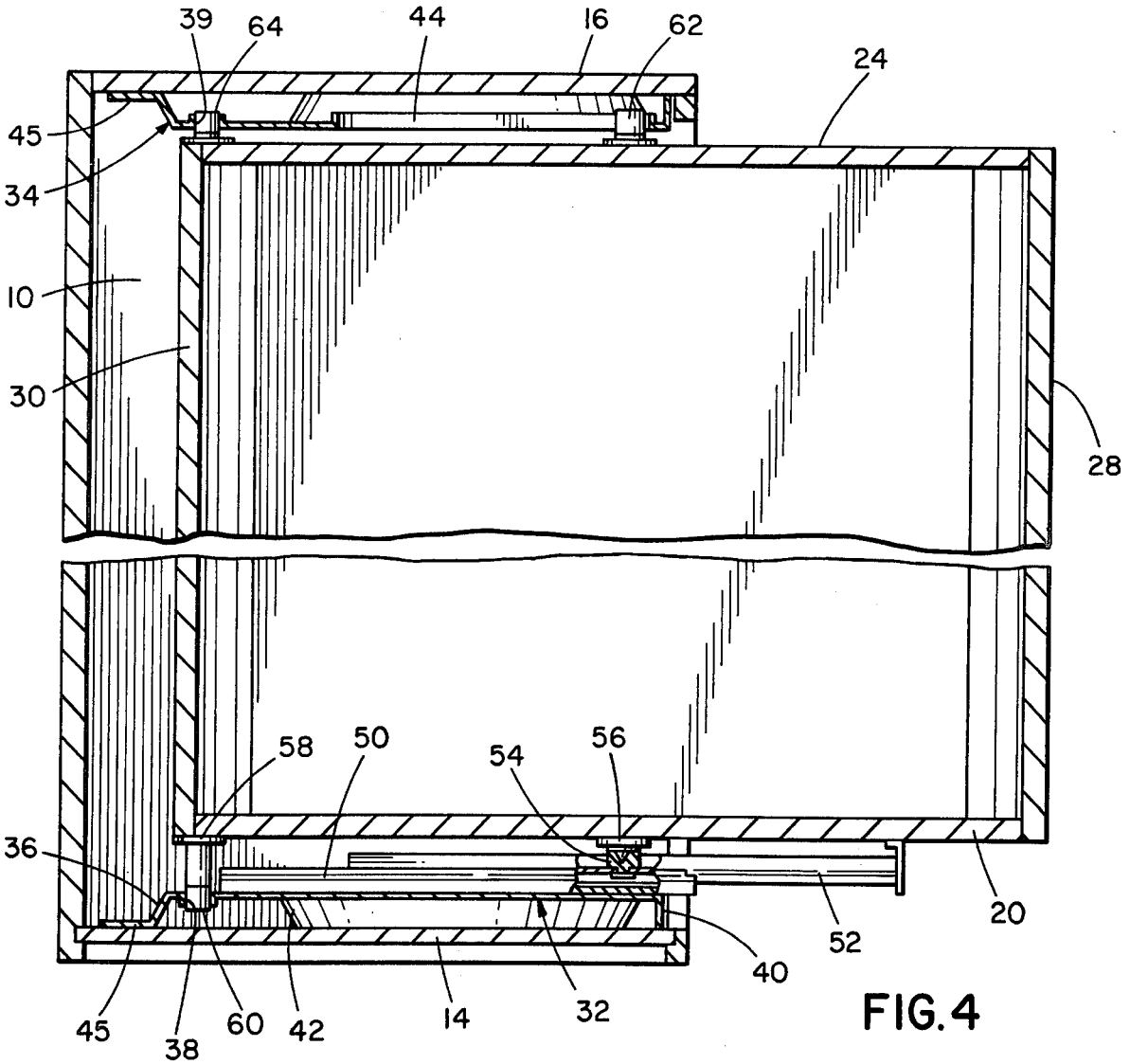
FIG. 4 is a side cross-sectional view of the cabinet and shelf unit shown in FIG. 3.
Figure 7:
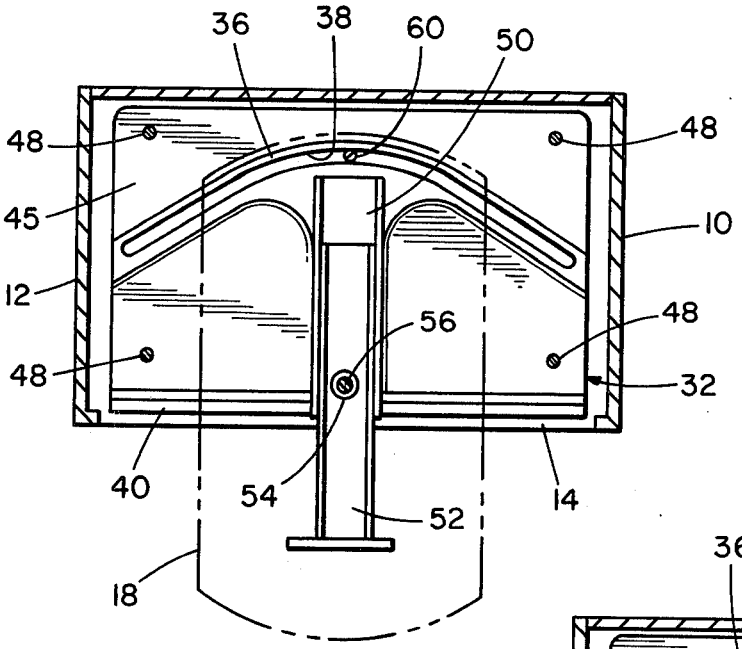
FIG. 7 is a top plan, cross-sectional view similar to FIG. 6 wherein the shelf unit has been moved to the position shown in FIG. 3.

Ultimately, the shelf unit 18 moves to the position illustrated in FIG. 3. FIG. 7 illustrates in cross section the position of th center pivot 56 and follower 60 when the shelf unit 18 has been rotated to the position shown in FIG. 3.

Figure 8:
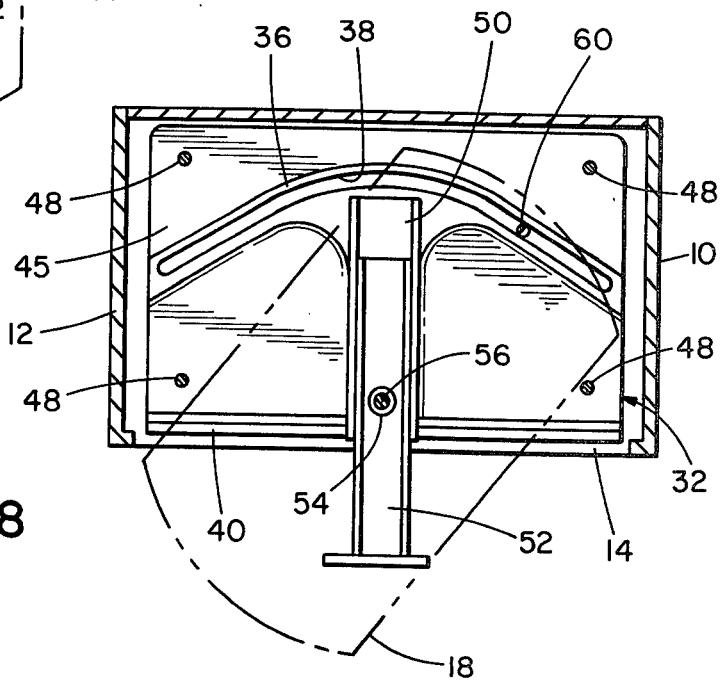
FIG. 8 is a top plan view similar to FIGS. 6 and 7 wherein the shelf unit is moved into the reverse position relative to the position shown in FIG. 6.

Pivoting of the shelf unit 18 is then continued generally in the clockwise direction. This continued pivoting action is illustrated in FIG. 8. As the shelf unit 18 is pivoted and the followers 60, 64 move in their appropriate slots 38, 39 respectively to again position the shelf unit 18 within the cabinet. However, the opposite side of the shelf unit 18 is facing outward. To reverse the shelf unit 18 against the direction of movement of the unit 18 is reversed.

With the hardware associated with the shelf unit 18 and cabinet of the present invention, it is possible to merely insert the plates 32 and 34 within a cabinet and attach appropriate followers to the shelf unit 18 either at the side of installation for the cabinets or at the factory. Additional cutting of the top and bottom 14 and 16 of the cabinet is not required. The panels 32 and 34 are merely attached by means of the screws 48. The necessity for cutting the panels 14 and 16 and the requirement for jigs and other means for insuring a proper cut have been eliminated. This constitutes an important step forward relative to the structure described previously as prior art wherein plates 32 and 34 were not provided.

Thus, while there has been set forth a preferred embodiment of the present invention, it is to be understood that the invention shall be limited only by the following claims and their equivalents.

What is claimed is:

1. An improved shelf construction comprising, in combination:

a generally rectangular shelf housing having a bottom panel, an opposed top panel and a front edge;

a shelf unit positioned within the housing, said unit comprising a plurality of connected horizontal shelves with a bottom shelf and a top panel in opposed relation respectively with the bottom and top panels of the housing; and improved hardware for pivotally and reversibly mounting the shelf unit within the housing, said hardware including (a) a lower mounting plate attached to the bottom panel of the housing, said mounting plate including a projected surface with a slide support mounted on the surface to define a moving center pivot for a pivot axis member projecting downwardly from the shelf unit whereby the pivot axis member may be translated in a direction perpendicular to the front edge, said plate also including an arcuate slot inward from the slide support, the ends of the slot being closer to the front edge than the mid portion of the slot, said slot engaging a follower projecting downward from one side edge of the shelf unit; and (b) an upper mounting plate attached to the top panel in opposed relation with the lower plate, said upper plate defining a mirror image arcuate slot to the lower plate arcuate slot and also having a straight follower slot defining a mirror image to the slide support, said top panel of said shelf unit including an upwardly projecting center follower and a side edge follower for cooperation with the arcuate slot and straight slide respectively; whereby the shelf unit is pivotal about the center follower and pivot member and the side edge followers are movable from one side of the arcuate slot to the other to thereby reverse the shelf unit.

2. The improved construction of claim 1 wherein said mounting plates have outside corners and said plates are substantially dimensionally equal in size to the shelves, the outside corners of the plates forming support legs to maintain the projected surface spaced from the associated bottom and top panels, said legs adapted to receive fastening means for attaching the plates to the housing panels.

* * * * *